United States Patent [19]

Felder et al.

[11] Patent Number: 4,764,395

[45] Date of Patent: Aug. 16, 1988

[54] PROCESS FOR FINISHING A TEXTILE FABRIC WITH A RADIATION CROSSLINKABLE COMPOUND

[75] Inventors: Bruno Felder, Pfeffingen; Jean-Pierre Feron, Movelier, both of Switzerland

[73] Assignee: Ciba-Geigy Corporation, Ardsley, N.Y.

[21] Appl. No.: 925,016

[22] Filed: Oct. 30, 1986

[30] Foreign Application Priority Data

Nov. 6, 1985 [CH] Switzerland ..... 4760/85

[51] Int. Cl.[4] ..... B05D 3/06; B32B 27/00

[52] U.S. Cl. ..... 427/54.1; 428/267; 428/290; 8/115.53; 427/264

[58] Field of Search ..... 427/54.1, 264; 525/61; 430/287, 308; 428/290, 267; 8/115.53

[56] References Cited

U.S. PATENT DOCUMENTS

| | | | |
|---|---|---|---|
| 1,972,323 | 9/1934 | Shiraeff et al. . | |
| 3,698,899 | 10/1972 | Giberstein . | |
| 3,878,019 | 4/1975 | Chapman et al. | 427/54.1 |
| 4,012,352 | 3/1977 | Deyrup | 525/61 |
| 4,042,476 | 8/1977 | Collins et al. | 427/54.1 |
| 4,108,748 | 8/1978 | Portnoy et al. | 427/54.1 |
| 4,108,803 | 8/1978 | Green et al. | 430/280 |
| 4,272,620 | 6/1981 | Ichimura | 525/61 |
| 4,278,703 | 7/1981 | Toy et al. | 427/54.1 |
| 4,499,175 | 2/1985 | Curtis et al. | 430/308 |

FOREIGN PATENT DOCUMENTS

| | | |
|---|---|---|
| 2039700 | 3/1971 | Fed. Rep. of Germany . |
| 2124691 | 12/1971 | Fed. Rep. of Germany . |
| 1710588 | 12/1971 | Fed. Rep. of Germany . |
| 407039 | 8/1966 | Switzerland . |
| 1349058 | 3/1974 | United Kingdom . |

*Primary Examiner*—Michael R. Lusignan
*Assistant Examiner*—Margaret Burice
*Attorney, Agent, or Firm*—Edward McC. Roberts; Meredith C. Findlay

[57] ABSTRACT

A process for finishing a textile fabric by coating the fabric with a compound which is crosslinkable by reaction-initiation radiation, exposing the back of the coated material to reaction-initiating radiation to induce crosslinking of said compound exposed through the fabric web, and removing the non-crosslinked compound.

In accordance with the process of the present invention, the individual threads of the fabric act as a screen, so that crosslinking of the radiation-sensitive compounds by irradiation can only take place between the threads and not inside them, i.e. it takes place between the fibrils. This results in a differentiated porosity. The water resistance of the treated fabric is improved due to the crosslinking between the threads.

20 Claims, No Drawings

PROCESS FOR FINISHING A TEXTILE FABRIC WITH A RADIATION CROSSLINKABLE COMPOUND

The present invention relates to a novel process for finishing textile fabric.

The process of this invention comprises applying to the face of textile fabric a compound which is crosslinkable by reaction-initiating radiation, then exposing the back of said fabric to reaction-initiating radiation, and removing the non-crosslinked compound.

Throughout this specification, reaction-initiating radiation will be understood as meaning radiation in a wavelength which is able to induce changes, e.g. crosslinking reactions, in the irradiated compound. Examples of suitable sources of radiation are visible light, UV light and X-rays.

Accordingly, the invention is based on the finding that by coating textile fabric in a particular manner, in combination with a specific aftertreatment, it is possible to obtain a textile fabric which is not only water-resistant but are at the same time also permeable to steam and which, in contrast to conventionally coated or laminated fabric, largely retain their textile character.

Surprisingly, in accordance with the process of the present invention, the individual threads of the fabric act as a screen, so that crosslinking of the radiation-sensitive compounds by irradiation can only take place between the threads and not inside them, i.e. it takes place between the fibrils. This obviously results in a differentiated porosity. The water resistance of the treated fabric is attributed to the crosslinking between the threads and the steam permeability to the hollow areas within the threads.

Throughout this specification, compounds which are crosslinkable by reaction-initiating radiation shall be understood as being low and high molecular compounds which, in the form of thin layers, on exposure to reaction-initiating radiation of a corresponding wavelength undergo changes in solubility, such that by so-called development processes structuralisations can be produced in the layer. In principle, this can be effected by both the positive and the negative process.

However, in accordance with the present invention, crosslinking is effected by the negative process only, by which process non-removable crosslinkages form between the molecules of the compounds which are crosslinkable by reaction-initiating radiation at the areas subjected to exposure through a mask (here: fiber structure). The non-crosslinked compounds at the unexposed areas are then removed in a washing out or development operation.

Compounds which are crosslinkable by reaction-initiating radiation are known from a large number of scientific publications and patent specifications. A comprehensive survey of photocrosslinkable compounds which can be employed in the process of this invention is to be found for example in J. Kosar, Light Sensitive Systems, John Wiley & Sons, New York, 1965, Chapters 2, 6 and 7, in W. S. DeForest, Photoresist—Materials and Processes, MacGraw Hill Book Company, New York, 1975, in particular Chapters 2 and 4, and in K. Maas, Themen zur Chemie der Reproduktionsverfahren, Hüthig, Heidelberg, 1974, Chapters 5.1 to 5.3.

Furthermore, suitable compounds which are crosslinkable by radiation are also described for example in Angew. Chem. 94, (1982), pp. 471–564, Adv. Photochem. 11, pp. 1–103, (1979), and in J. Macromol. Sci.—Revs. Macromol. Chem. C21 pp. 187–273 (1981/82). This survey is rounded off by a great number of patent applications and specifications, e.g. DE-A-15 22 515; U.S. Pat. No. 4,079,041 and U.S. Pat. No. 4,272,620; EP-A-92 524; EP-A-134 752; EP-A-138 768; EP-A-132 221 and EP-A-141 781 and U.S. Pat. No. 2,670,286; U.S. Pat. No. 2,379,413; U.S. Pat. No. 2,299,839; U.S. Pat. No. 2,760,863 and U.S. Pat. No. 4,530,896.

Examples of suitable compounds which are crosslinkable by reaction-initiating radiation are linear polymers of polyvinyl alcohol or, epoxy resins advanced at the chain with terminal epoxide groups, or acrylate/methacrylate copolymers or butadiene-acrylonitrile copolymers and which contain as photocrosslinkable components either terminal vinyl groups or side groups of styrene-pyridinium, acrylamide or dimethylmaleimide.

Examples of compounds which are crosslinkable by reaction-initiating radiation and which are particularly suitable for the process of this invention are cinnamates of high molecular, polyhydric alcohols, polymers containing chalcone-like and benzophenone-like groups, and stilbenes which, in the absence or presence of sensitisers, form linkages under the influence of reaction-initiating radiation (cf. Kosar, op. cit., Chapter 4). Polyvinyl alcohol and a number of its derivatives, and also organic colloids, e.g. gelatines and starches in combination with crosslinking agents such as those metal dichromates described in Chapter 2 of Kosar (op. cit.), likewise number among preferred compounds which are crosslinkable by reaction-initiating radiation.

Polyvinyl alcohols modified with groups which are crosslinkable by reaction-initiating radiation, which polyvinyl alcohols are also suitable for use in the process of this invention, are described e.g. in U.S. Pat. No. 4,272,620.

Further preferred compounds which are crosslinkable by reaction-initiating radiation are those which have an average molecular weight of at least 1000 and which contain per molecule on average more than 2 maleimide groups of the formula

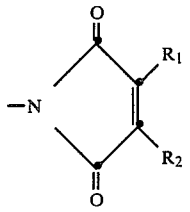

wherein $R_1$ and $R_2$ are each independently of the other $C_1$–$C_4$alkyl or they complete a 5- or 6-membered carbocyclic ring. The polymer structure to which these maleimide groups are attached is preferably a homo- or copolymer of monomers containing reactive double bonds. A detailed description of these photocrosslinkable polymers can be found in U.S. Pat. No. 4,079,041.

The homo- and copolymers described in published EP-A-92 524 which are crosslinkable by organic chromophoric polyazides by reaction-initiating radiation constitute a further preferred group of polymer compounds which are crosslinkable by reaction-initiating radiation.

Good results are also obtained with compounds containing intact acrylate double bonds. Thiol-ene systems are likewise suitable for the process of this invention. As described in Angew. Chem. 94 (1982), p. 480, said thiol-ene systems are formed by adding thiols to alkenes under the action of reaction-initiating radiation, with thioethers forming.

The homo- and copolymers according to EP-A-134 752 which are directly crosslinkable by the action of reaction-initiating radiation and which contain at least 5 mol%, based on the polymer, of structural units of the formula

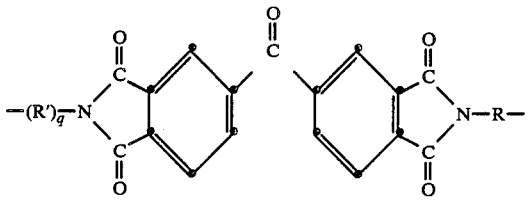

wherein R and R′ are each independently the divalent radicals indicated in the cited patent application and q is 0 or 1, are also particularly suitable.

Further homo- and copolymers which are preferred for use in the process of this invention are described in EP-A-132 221 and EP-A-141 781. Essentially, these homo- and copolymers contain the recurring structural units of the type

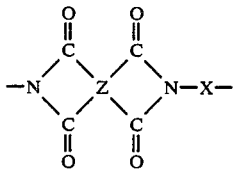

wherein Z and X are as defined in the references cited, and may, if the conditions described in EP-A-132 221 are fulfilled, be crosslinked without the addition of sensitisers or crosslinking agents.

The radiation-sensitive homo- and copolycondensation products selected from the group of linear saturated polyamides, polyesters, polyamidimides, polyester imides and polyester amides based on benzophenonedicarboxylic acids and benzophenonetricarboxylic acids according to EP-A-138 768, which products contain the recurring structural units of the formula

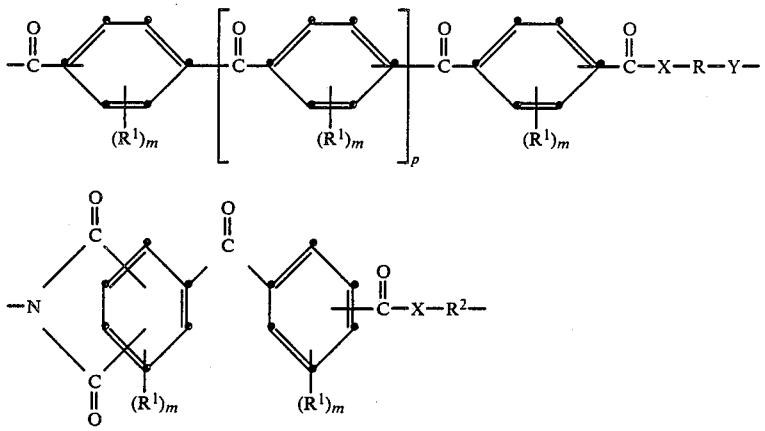

and, in the case of copolycondensation products, additionally contain the recurring structural units of the formulae

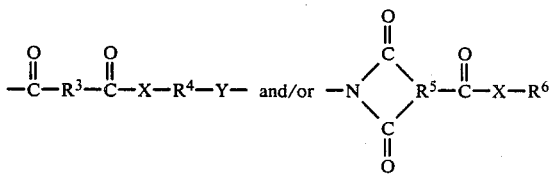

in which formulae the substituents are as defined in the cited application, also belong to the group of preferred compounds which are crosslinkable by reaction-initiating radiation.

Examples of compounds which can also be employed with advantage in the process of this invention are the photosensitive systems according to EP-A-152 377, e.g. ethylenically unsaturated compounds such as olefines, vinyl ethers and vinyl esters, and epoxides which are photocrosslinkable in the presence of a cationic sensitiser and an oxidating agent, as well as silcone-based systems sensitive to reaction-initiating radiation, e.g. modified dimethylpolysiloxanes, methyl-H-polysiloxanes and silicone elastomers which are crosslinkable by reaction-initiating radiation, and also perfluoroalkyl group-containing polymers which are crosslinkable by reaction-initiating radiation. Particularly preferred silicone-based systems which are sensitive to reaction-initiating radiation are those siloxanes which contain terminal epoxide groups and which are photocrosslinkable in the presence of cationic sensitisers, e.g. ferrocenium, iodonium or sulfonium complexes.

Of the compounds cited, those compounds with an essentially linear basic structure, e.g. as is the case with polyvinyl alcohol and its derivatives (e.g. according to U.S. Pat. No. 4,272,620), are particularly suitable for use in the process of this invention. The compounds which are crosslinkable by reaction-initiating radiation are applied in the form of a solution or dispersion to the textile fabric.

Suitable solvents or dispersants are water and organic, in particular polar, solvents, e.g. alcohols, ethers, ether alcohols, esters, aldehydes and ketones, in particular methyl ethyl ketone, furfural, benzaldehyde, morpholine, acetophenone and cyclohexanone. Provided this is permitted by the solubility properties of the compounds which are crosslinkable by reaction-initiating radiation, it is preferred to select aqueous solutions of said compounds for coating the textile fabric.

If desired, the sensitisers known from the literature may be added to the solution or dispersion of the photocrosslinkable compound in order to increase the photosensitivity of said compound. Examples of such sensitisers are mono- or polycyclic aromatic or heteroaromatic compounds, phenones, in particular acetophenones and benzophenones, benziles, xanthones, stilbenes, thioxanthones, phthalimides, phthalimide thioethers and diones with adjacent carbonyl groups. Further lists of suitable sensitisers can be found e.g. in S. L. Murow, Handbook of Photochemistry, M. Dekker Inc., New York, pp. 27 ff (1973) and also in GB-A-2 119 364, U.S. Pat. No. 4,363,917, U.S. Pat. No. 4,459,414 and U.S. Pat. No. 4,348,530 and EP-A-152 377.

When using specific crosslinkable compounds, e.g. those indicated in EP-A-92 524, a crosslinking agent which under the action of reaction-initiating (e.g. actinic) radiation induces the crosslinking of the compound must be added to the solution or dispersion. Such crosslinking agents are known from the literature. They are, as a rule, metal dichromates or low molecular organic compounds containing e.g. two functional groups, e.g. azido, carbonazido or sulfazido groups, which when irradiated, e.g. with light, split off nitrogen. The remaining reactive imenes then bind adjacent polymers.

In order to influence the water repellency of the polymer employed, customary water-repellent agents, e.g. those based on fluorine or silicone, can be added to the solution or dispersion.

Moreover, customary thickeners, e.g. finely particulate silicon dioxide, silicates, bentonites, kaolins, titanium dioxide and calcium carbonate, may be employed to bring the viscosity of the solution or dispersion to a suitable value. The viscosity can also be controlled by adjusting the temperature of the solution or dispersion to a temperature in a specific range.

Solutions or dispersions of compounds which are crosslinkable by reaction-initiating radiation preferably contain 5 to 50% by weight of polymer, 0 to 5% by weight of sensitiser, 0 to 20% by weight of crosslinking agent, 0 to 10% of water-repellent agent and 0 to 10% by weight of thickener.

Particularly suitable solutions of compounds which are crosslinkable by reaction-initiating radiation are aqueous solutions containing 5 to 15% by weight of polyvinyl alcohol derivative.

The textile fabric is coated with the polymers by methods known per se, for example using a stippled coating roller or a doctor knife, by immersing, spraying or brushing on.

In general, suitable textile fabrics are wovens, knits and nonwovens. These fabrics may be prepared from all customary natural and synthetic fibre materials such as cotton, linen, regenerated cellulose, cellulose acetate ($2\frac{1}{2}$- or triacetate), polyester, polyacrylonitrile, polyamide, polyurethane, wool, silk, polyolefines, in particular polypropylene, or, especially, blends of various fibres, with blends of polyurethane fibres (3–30) with cotton, polyester or synthetic polyamide fibres (70–97) being preferred. If desired, the fabric may be impregnated with agents which improve the performance characteristics. Examples of such agents are, in particular, water-repellent and/or oil-repellent agents, e.g. aqueous silicone oil emulsions, organic solutions of organopolysiloxanes, grease-modified melamine resins, fluorine chemicals or water-soluble chromium complexes of stearic acid. Such coatings exhibit good resistance to dry cleaning.

If desired, in order to increase the contrast to the reaction-initiating radiation, these textile fabrics can be pretreated with suitable contrast agents (in the case of dyed substrates, when employing UV-crosslinking radiation, the intrinsic UV absorption of the dyeing is generally sufficient). If appropriate, white substrates are to be dyed with UV absorbers [e.g. 2-(3′-tert-butyl-2′-hydroxy-5′-methylphenyl)-5-chlorobenzotriazole] or with UV-absorbing fluorescent whitening agents.

Further examples of agents which improve the performance characteristics are flame retardants, anti-bacterial agents, non-iron or wash-and-wear preparations, softeners, dyes, pigments or fluorescent whitening agents.

The coated textile fabric is then dried at a temperature in the range from 20° to 180° C., preferably from 80° to 130° C., in conventional heating devices.

The add-on is dependent on the respective properties of a particular textile fabric. Good results are obtained in general with an add-on amounting in the dry state to 5 to 15 g/m$^2$.

The back of the dried fabric is exposed to reaction-initiating, e.g. actinic, radiation in a manner known per se. The exposure time depends on the intensity of the source of radiation and can vary within wide limits. The upper limit of exposure time has of course been exceeded when the radiation-sensitive compounds located directly behind the threads of the fabric can, e.g. by scattering or refractive effects, absorb so much energy that they also form crosslinkages.

In order to remove the non-crosslinked polymers from the textile fabric, it is subsequently washed in water or in one of the above-mentioned organic, in particular polar, solvents, if desired, at elevated temperature, i.e. at a temperature which impairs neither the structure of the coating nor that of the textile fabric, preferably in the temperature range from 30° to 80° C. The fabric is then dried.

The textile fabric treated by the process of this invention are not only waterproof but are also permeable to steam. The process of this invention is therefore suitable for a wide variety of textile fabrics which—to varying degrees—have to meet these requirements. The process is suitable preferably for textiles which can be used for the manufacture of e.g. sportswear articles such as ski jackets, ski suits and anoraks, and of wind-cheaters, coats, in particular raincoats, working clothes, protective clothing and sleeping bags.

In accordance with the present invention, depending on the requirements, the steam permeability and the waterproofness of the textile fabrics can be coordinated by the choice of exposure time or of the intensity of the reaction-initiating radiation (cf. Examples 2 to 8).

EXAMPLE 1

Red polyamide 6.6 (nylon filament fabric: mass per unit area 65 g/m$^2$) which has been waterproofed with a fluorocarbon polymer (e.g. Oleophobol SY®) is coated by means of a draw-frame doctor knife (100μ) with a coating substance consisting of a 10% aqueous solution of the polyvinyl alcohol derivative according to U.S. Pat. No. 4,272,620, Examples 1, 2 and 16, which solution contains 3% by weight of a fluorocarbon polymer (e.g. Oleophobol SY ®), and the coated polyamide is subsequently dried at 120° C. The add-on of the resultant layer was determined as being 7 g of polymer/m$^2$.

The back of the material thus coated is exposed for 20 minutes to a Philips HPR lamp (125 watt) from a distance of 18 cm, and is then washed for 5 minutes in a water bath at 50° C. Drying is effected at 130° C.

In order to determine the waterproofness, the water column is measured in accordance with the hydrostatic head test AATCC 1952-18. The water column was 72 cm, which is an indication of the good waterproofness of the nylon filament treated by the process of this invention. In the case of waterproofed material which had not been treated by the process of this invention, the water column was only 17 cm.

By the standard method according to DIN 53122, the steam permeability was determined as being 38 g/m$^2$h. The nylon filament treated by the process of this invention is thus characterised by a good steam permeability. The untreated waterproofed material exhibited a steam permeability of 50 g/m$^2$.

EXAMPLE 2

Red polyamide 6.6 (nylon filament fabric: mass per unit area 65 g/m$^2$) which has been waterproofed with a fluorocarbon polymer (e.g. Oleophobol SY ®) is coated twice by means of a drawframe doctor knife (100μ) with a coating substance consisting of a 10% aqueous solution of the polyvinyl alcohol derivative according to U.S. Pat. No. 4,272,620, Examples 1, 2 and 16, which solution contains 3% by weight of a fluorocarbon polymer (e.g. Oleophobol SY ®), and the coated polyamide is subsequently dried for 2 minutes at 100° C. The add-on of the resultant layer was determined as being 7 g of polymer/m$^2$.

The back of the material thus coated is exposed for various lengths of time to a Philips HPR lamp (125 watt) from a distance of 18 cm, and is then washed for 5 minutes in a water bath at 50° C. Drying is effected at 130° C.

To determine the water resistance, the waterproofness is measured according to DIN 53886, and the steam permeability is determined by the standard method according to DIN 53122. The fabric samples obtained have the following characteristics:

TABLE 1

| Exposure min. | Steam permeability g/m$^2$h | Waterproofness mbar |
|---|---|---|
| 0 | 50 | 17 |
| 2 | 40 | 49 |
| 5 | 36 | 62 |
| 10 | 34 | 72 |
| 20 | 31 | 81 |

EXAMPLE 3

By repeating the procedure of Example 2 but using a coating substance which additionally contains 5% of $H_3PO_4$, fabric samples with the following characteristics are obtained:

TABLE 2

| Exposure min. | Steam permeability g/m$^2$h | Waterproofness mbar |
|---|---|---|
| 0 | 44 | 17 |
| 2 | 36 | 103 |

TABLE 2-continued

| Exposure min. | Steam permeability g/m$^2$h | Waterproofness mbar |
|---|---|---|
| 5 | 33 | 122 |
| 10 | 28 | 130 |
| 20 | 17 | >147 |

EXAMPLE 4

Using a 15μ doctor knife, the oilproofed test fabric described in Example 2 is coated with the following coating substance instead of with that indicated in Example 2:

5 g of a vinyl-terminated butadiene-acrylonitrile copolymer (e.g. Hycar ® VTBN)

15 g of hydroxyethyl methacrylate 0.4 g of a photopolymerisation initiator, e.g. 2-morpholino-(p-methylthioisobutyrophenone), 0.5 g of pyrogenic silicic acid (e.g. Aerosil Silica R 202 ®)

The fabric is subjected to exposure as in Example 2, but under a nitrogen atmosphere. The exposed material is subsequently developed for 30 seconds in acetone at room temperature. After further oilproofing with 35 g/l of a fluorocarbon polymer (e.g. Oleophobol SY ®) and 0.8 g/l of acetic acid in water and 2 minutes' drying at 100° C., fabric samples with the following characteristics are obtained:

TABLE 3

| Exposure min. | Steam permeability g/m$^2$h | Waterproofness mbar |
|---|---|---|
| 0 | 47 | 15 |
| 2 | 43 | 51 |
| 5 | 43 | 63 |
| 10 | 39 | 58 |
| 20 | 36 | 69 |

EXAMPLE 5

An epoxy resin containing photopolymerising acrylamide side groups is prepared in accordance with the method described in Example 1 of U.S. Pat. No. 4,108,803. Instead of ethylene glycol, 1,4-butanediol is employed as diol component. The condensation of the diol with 1,3-diglycidyl-5,5-hydantoin is effected up to an epoxide content of 0.1 equivalents/kg (instead of 0.32 equivalents/kg as in the cited Example). The reaction of this condensate with N-hydroxymethyl acrylamide is carried out in the molar ratios and under the reaction conditions indicated in the cited Example. A 50% solution of this epoxy resin in ethanol, which solution contains 3% of a 1:1 mixture of benzophenone and 1-benzoylcyclohexanol as initiator, is applied once to the oilproofed polyamide 6.6 fabric described in Example 2 using a 35μ doctor knife.

The back of the fabric is subjected to exposure as in Example 4. The exposed material is then developed for 2 minutes in ethanol, dried in air and oilproofed again as in Example 4.

Fabric samples with the following characteristics are obtained:

TABLE 4

| Exposure min. | Steam permeability g/m²h | Waterproofness mbar |
|---|---|---|
| 0 | 46 | 13 |
| 2 | 44 | 26 |
| 5 | 41 | 26 |
| 10 | 41 | 39 |
| 20 | 35 | 60 |

EXAMPLE 6

The procedure of Example 5 is repeated, except that the photocrosslinkable epoxy resin employed has an epoxide content of 0.33 equivalents/kg. A coating substance of the following composition is applied:

68% of epoxy resin

10% of a photopolymerisation initiator, e.g. a 1:1 mixture of benzophenone and 1-benzoylcyclohexanol, 5% of a fluorocarbon polymer (e.g. Oleophobol SY®)

17% of water

The exposed material is developed for 5 minutes in ethanol at 50° C.; drying is effected for 2 minutes at 100° C. The material is not oilproofed again.

Fabric samples with the following characteristics are obtained:

TABLE 5

| Exposure min. | Steam permeability g/m²h | Waterproofness mbar |
|---|---|---|
| 0 | 50 | 13 |
| 2 | 36 | 53 |
| 5 | 33 | 58 |
| 10 | 37 | 68 |

EXAMPLE 7

A photocrosslinkable copolymer, prepared according to U.S. Pat. No. 4,079,041, consisting of 20% of methyl methacrylate, 12.5% of 2-dimethylaminoethyl methacrylate and 67.5% of N-(hydroxyethoxyethyl)dimethylmaleimide methacrylate (U.S. Pat. No. 4,532,332) is dissolved in a 1:1 solvent mixture of ethyl methyl ketone and 1-methoxy-2-propanol such that the resultant solution contains 50% by weight of said copolymer. 1.5% of ethyl 6-methylthioxantone-2-carboxylate (based on the polymer) are added as sensibiliser to said solution.

The coating substance is applied once with a 50μ doctor knife to the test fabric described in Example 2, and the coated fabric is dried in air. The back of the fabric is subjected to exposure as in Example 2.

The material is developed for 2 minutes in a 2% acetic acid solution and subsequently washed in water. After drying for 10 minutes at 100° C. and further oilproofing as in Example 4, fibre samples with the following characteristics are obtained:

TABLE 6

| Exposure min. | Steam permeability g/m²h | Waterproofness mbar |
|---|---|---|
| 0 | 42 | 16 |
| 5 | 47 | 41 |
| 10 | 44 | 56 |
| 20 | 44 | 58 |

TABLE 6-continued

| Exposure min. | Steam permeability g/m²h | Waterproofness mbar |
|---|---|---|
| 40 | 42 | 65 |

EXAMPLE 8

By repeating the procedure of Example 7 but using a photocrosslinking copolymer consisting of 80% of ethyl acrylate, 12.5% of 2-dimethylaminoethyl methacrylate and 7.5% of N-(hydroxyethoxyethyl)dimethylmaleimide methacrylate (U.S. Pat. No. 4,532,332), fabric samples with the following characteristics are obtained:

TABLE 7

| Exposure min. | Steam permeability g/m²h | Waterproofness mbar |
|---|---|---|
| 0 | 51 | 16 |
| 2 | 46 | 23 |
| 5 | 40 | 59 |
| 10 | 33 | 72 |
| 20 | 29 | 81 |

EXAMPLE 9

The procedure of Example 8 is repeated but using a photocrosslinking copolymer consisting of 80% of N-(hydroxyethoxyethyl)dimethylmaleimide methacrylate (U.S. Pat. No. 4,532,332) and 20% of ethyl acrylate in 60% solution in a 1:1 mixture of ethyl methyl ketone and 1-methoxy-2-propanol.

Development is effected in acetone (½ minute). After further oilproofing and drying as in Example 4, fabric samples with the following characteristics are obtained:

TABLE 8

| Exposure min. | Steam permeability g/m²h | Waterproofness mbar |
|---|---|---|
| 0 | 53 | 15 |
| 15 | 43 | 60 |
| 20 | 43 | 62 |
| 30 | 44 | 61 |
| 40 | 42 | 59 |

What is claimed is:

1. A process for finishing a textile fabric, which process comprises coating in a thin layer on the face of textile fabrics at least one compound which is crosslinkable by reaction-initiating radiation, then exposing the back of said fabric to reaction-initiating radiation to induce crosslinking of said compound exposed through the fabric web, and removing the non-crosslinked compound.

2. A process according to claim 1, wherein the crosslinkable compound is a polymeric compound which is crosslinkable by reaction-initiating radiation.

3. A process according to claim 2, wherein the polymeric compound which is crosslinkable by reaction-initiating radiation is a linear polymer.

4. A process for finishing textile fabric which comprises coating in a thin layer on the surface of the fabric at least one compound which is crosslinkable by reaction-initiating radiation, said compound being a linear polymer of polyvinyl alcohol, epoxy resins advanced at the chain with terminal epoxide groups, acrylate/methacrylate copolymers or butadiene-acrylonitrile copolymers, each of which polymer contains as crosslinkable components either terminal vinyl groups or side groups of styrene-pyridinium, acrylamide or dimethylmaleimide then exposing the back of said fabric to reaction-initiating radiation to induce crosslinking of said compound exposed throght the fabric web and removing the non-crosslinking compound.

5. A process according to claim 4, wherein the crosslinkable compound is applied in the form of a solution or dispersion to the textile fabric.

6. A process according to claim 5, wherein the solvent or dispersant is water or an organic solvent.

7. A process according to claim 6, wherein the solvent is water.

8. A process according to claim 5, wherein the solution or dispersion of the compound which is crosslinkable by reaction-initiating radiation contains a sensitizer, a crosslinking agent, a water-repellent agent or a thickener.

9. A process according to claim 8, wherein the sensitiser is a mono- or polycyclic aromatic or heteroaromatic compound, a phenone, a stilbene, a benzile, a xanthone, a thioxanthone, a phthalimide, a phthalimide thioether or a dione with adjacent carbonyl groups.

10. A process according to claim 8, wherein the crosslinking agent is a metal dichromate or a low molecular organic compound containing functional groups.

11. A process according to claim 8, wherein the water-repellent agent is one based on fluorine or silicone.

12. A process according to claim 8, wherein the thickener is silicon dioxide, a silicate, a bentonite, a kaolin, titanium dioxide or calcium carbonate.

13. A process according to claim 8, wherein the solution or dispersion of the compound which is crosslinkable by reaction-initiating radiation contains (a) 5 to 50% by weight of compound which is crosslinkable by reaction-initiating radiation,
(b) 0 to 5% by weight of sensitizer,
(c) 0 to 20% by weight of crosslinking agent,
(d) 0 to 10% by weight of water-repellent agent and
(e) 0 to 10% by weight of thickener.

14. A process according to claim 13, wherein the solution of the compound which is crosslinkable by reaction-initiating radiation is an aqueous solution containing 5 to 15% by weight of polyvinyl alcohol derivative.

15. A process according to claim 1, wherein the non-crosslinked compound is removed with water or an organic solvent.

16. A process according to claim 1, wherein the textile fabrics are wovens, knits and non-wovens made of customary natural and synthetic fibers.

17. A process according to claim 16, wherein the textile fabric contain synthetic fiber materials.

18. A process according to claim 17, wherein the synthetic fiber materials are nylon filament fabrics.

19. A textile fabric finished by the process according to claim 1.

20. Waterproofed synthetic fiber materials finished by the process according to claim 1.

* * * * *